United States Patent [19]

Dorléans et al.

[11] Patent Number: 4,583,603

[45] Date of Patent: Apr. 22, 1986

[54] DRILL PIPE JOINT

[75] Inventors: André Dorléans, Le Perray-en-Yvelines; Georges Fermaud, Nimes, both of France

[73] Assignee: Compagnie Francaise des Petroles, Paris, France

[21] Appl. No.: 758,258

[22] Filed: Jul. 24, 1985

[30] Foreign Application Priority Data

Aug. 8, 1984 [FR] France ..... 84 12510

[51] Int. Cl.[4] ..... E21B 17/18

[52] U.S. Cl. ..... 175/324; 175/320

[58] Field of Search ..... 175/76, 323, 324, 325, 175/320, 393, 394, 100

[56] References Cited

U.S. PATENT DOCUMENTS

| | | | |
|---|---|---|---|
| 2,765,146 | 10/1956 | Williams, Jr. | 175/324 |
| 3,908,771 | 9/1975 | Garrett | 175/325 |
| 4,223,747 | 9/1980 | Marais | 175/324 |
| 4,540,055 | 9/1985 | Drummond et al. | 175/324 |

*Primary Examiner*—James A. Leppink
*Assistant Examiner*—Terry Lee Melius
*Attorney, Agent, or Firm*—Sughrue, Mion, Zinn, Macpeak and Seas

[57] ABSTRACT

A drill pipe joint for insertion in a drill pipe comprises a body having an axial bore therethrough and comprising generally cylindrical upper and lower portions and a widened cylindrical intermediate portion at the upper end of which at least three cutouts are formed for insertion therein of removable attached members each provided with an upwardly directed internal passage connecting the bore to an interchangeable nozzle mounted in the upper end of the passage and situated on a diameter intermediate the outside diameter of the intermediate portion and that of the upper portion of the body.

The joint is particularly suitable for passing through a zone in which circulation is lost and is arranged in the drill pipe string above the level of the zone of lost circulation.

8 Claims, 3 Drawing Figures

DRILL PIPE JOINT

The present invention relates essentially to the drilling of a well through a zone in which circulation is lost.

In the drilling of a well using a drilling tool mounted at the lower end of a drill pipe serving to apply a load to the tool and to drive it rotationally, the tool receives via the bore in this pipe a drilling liquid whose purpose is at one and the same time to cool the tool, clean the cutting face, and bring the debris to the surface via the annular space between the well and the drill pipe.

The purpose of the drilling liquid is no longer appropriately served if the well passes through a zone where circulation is lost, because the flow of drilling liquid must then be reduced and the return circulation of the drilling liquid to the surface is impaired or fails completely. This results in the slowing-down of the drilling operations and the risk of deterioration of the portion of the well wall which can no longer be in contact with the drilling liquid.

According to the present invention there is provided a drill pipe joint comprising a body elongated on a vertical axis, provided internally with an axial bore, and comprising upper and lower generally cylindrical end portions provided at their free ends with screw connection means for connection of the joint in a drill pipe, and an intermediate widened portion whose outside diameter is greater than the outside diameter of the upper portion, thus providing an upper face at its connection to the upper portion, wherein the intermediate portion is provided with at least three cutouts, each of which extends into the upper face and to said axial bore and which are regularly distributed circumferentially relative to one another, and each of the cutouts has inserted into it an attached member provided with an upwardly directed internal passage opening at its lower end into said bore and ending at its upper end in a nozzle which is situated on a diameter intermediate the outside diameter of said intermediate portion and the outside diameter of said upper portion.

In use the outside diameter of said intermediate portion is selected to be smaller than the diameter of the well drilled, and the drilling liquid is divided at this internal passage into a first flow which follows the usual path, downwardly in the drill pipe, over the drilling tool, and upwardly in the annular space between the well and the drill pipe, and into a second flow which passes into said internal passages and rises directly in the annular space without causing any erosion of the walls of the well.

The invention will be more fully understood from the following description of an embodiment thereof, given by way of example only, with reference to the accompanying drawings.

Figure 1:
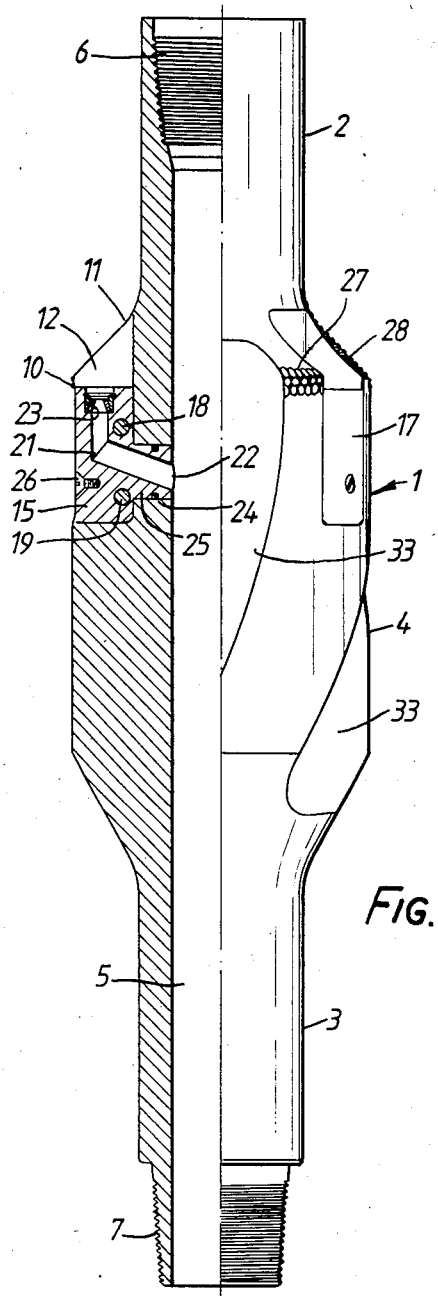
FIG. 1 shows an embodiment of a drill pipe joint according to the invention in axial half-section and half-elevation.
Figure 3:
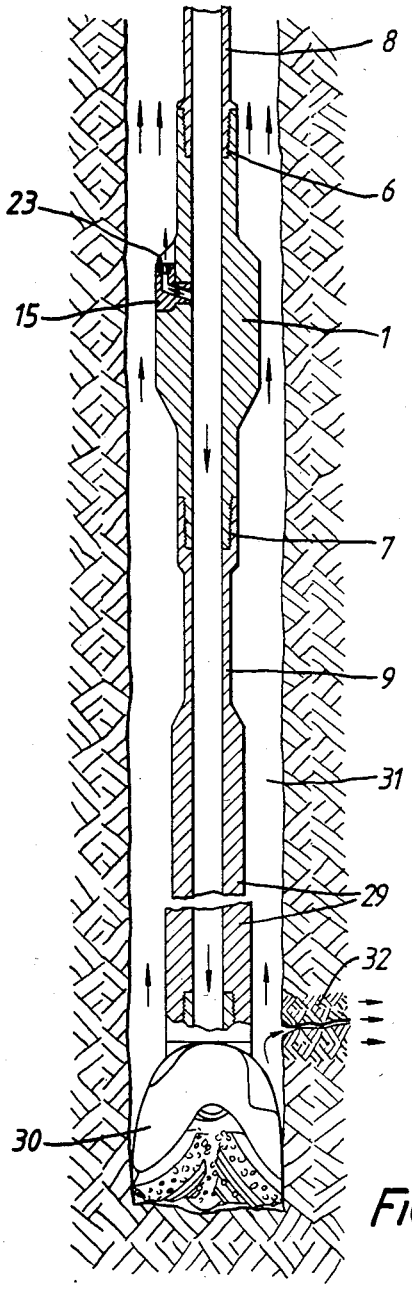
FIG. 3 shows in vertical section the joint of FIG. 1 inserted in a drill pipe which has been lowered into a well which is being drilled.

In FIG. 1 a drill pipe joint comprises a monobloc body 1 comprising an upper cylindrical portion 2, a lower cylindrical portion 3, and an intermediate cylindrical portion 4, and an axial bore 5. These portions, described as cylindrical, may be substantially cylindrical and may have slight conicity. The upper and lower portions 2 and 3 are provided at their free ends with screwthreads 6 and 7, which are respectively female and male and which permit connection between an upper section 8 and a lower section 9 of a drill pipe string, as shown in FIG. 3. The outside diameter of the intermediate portion 4 is larger than the outside diameter of the upper portion 2 and lower portion 3. For example, the portions 2 and 3 may have an outside diameter of 20.3 cm, while the outside diameter of the portion 4 may be 28.6 cm. The upper edge 10 formed on the upper perimeter of the intermediate portion 4 is connected to the upper portion 2 by an upper connection face 11, which as shown has a generally frustoconical shape of which the edge 10 forms the outer periphery.

Figure 2:
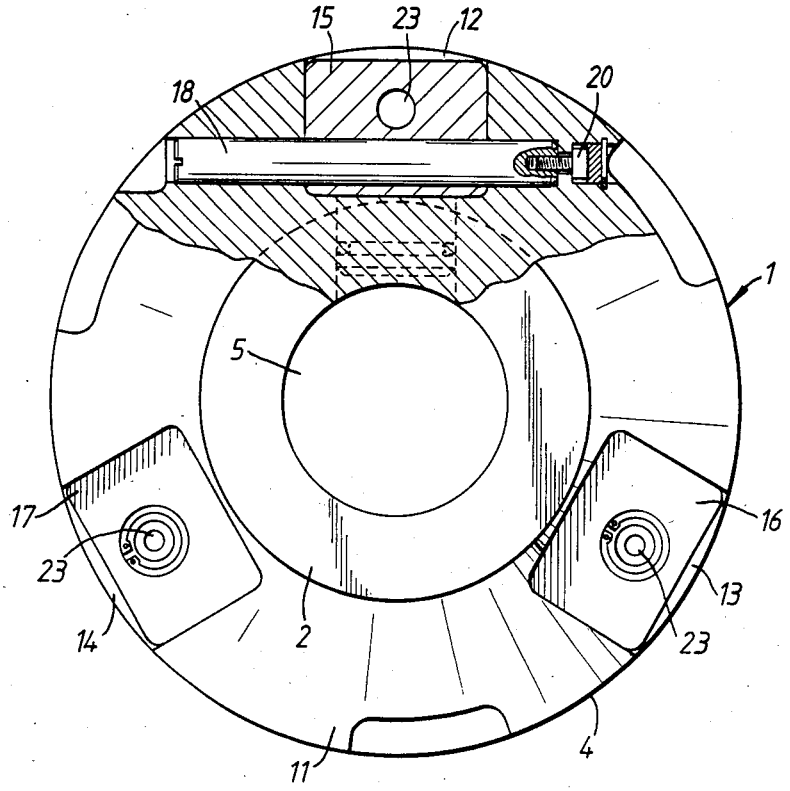
FIG. 2 shows the drill pipe joint of FIG. 1 on a larger scale, in top plan view, partly in section.

In the portion 4 and the face 11 there are formed three cutouts 12, 13, 14 distributed equiangularly around the circumference, as can be seen in FIG. 2. Removable attached members 15, 16, 17 of treated steel are introduced into these cutouts, each member being held by at least one pin. As shown, two pins 18, 19 are provided, the pins being inserted into aligned holes in the respective attached member and the portion 4 and held by screws, such as the screw 20 visible in FIG. 2.

Each attached member has passing through it an internal passage 21, which is visible in FIG. 1 and which extends from a lower inlet 22 opening in the bore 5 to an upper outlet provided with a nozzle 23 and discharging vertically upwardly on a diameter intermediate the respective outside diameters of the upper portion 2 and intermediate portion 4. Each nozzle 23 comprises an interchangeable member of tungsten carbide positioned in the passage 21 and provided in a manner known per se with a seal and a retaining circlip. A seal 24 is also provided between the intermediate portion 4 and each attached member 15, 16, 17. In order to facilitate the making of a leaktight connection between portion 4 and each attached member, a cylindrical shape is given to portion 25 of each attached member 15, 16 or 17 and to that portion of the cutout 12, 13, 14 receiving it, in the region of the bore 5. A threaded hole, which during operation is closed by a screw 26, facilitates the positioning and extraction of the attached member 15, 16 or 17. It is thus possible, while retaining the same body 1, to change not only the attached members 15, 16 and 17 but also the nozzles 23 when wear makes this necessary.

The attached members 15, 16, 17 restore the cylindrical surface of the intermediate portion 4, but allow the retention of the openings in the connection portion defined by the frustoconical upper connection face 11. These openings lie between two inwardly directed generally radially extending edges of the face 11. These edges ensure the protection of the nozzles 23. In order to permit a certain redrilling during the raising of the drill pipe string, a reinforcement of a hard material, such as tungsten carbide, is provided at 27 on what remains of the edge 10 after the cutouts 12, 13, 14 have been made, and on that edge of each said opening which constitutes a leading edge in accordance with the sense of rotation of the drill pipe.

In FIG. 3 the joint 1 is shown installed in a drill pipe above the drill stems 29 carrying the drilling tool 30. The latter is shown drilling a well 31 whose wall includes a lost circulation zone 32. Circulation of the drilling liquid is shown by arrows.

The joint 1 is placed above the lost circulation zone 32. The closer it is to that zone, the more effective its action will be, but it must never extend across it. It will therefore be necessary to raise the drill pipe and reposition the joint 1 in a higher position when the drill pipe approaches the zone 32. This raising operation will be carried out as many times as are necessary to enable the drilling tool to reach the final drilling level before installation of a casing. The distance between the joint 1 and the drilling tool will generally be greater than 150 meters.

A joint 1 whose intermediate portion 4 has an outside diameter of 28.6 cm is suitable for a well of a diameter of 44.3 cm, for example. It may also be used in a narrower well, for example a well of a diameter of 31.1 cm, but it is then preferable to use a joint 1 provided on the cylindrical surface of the intermediate portion 4 with helical grooves, such as grooves 33 shown in FIG. 1, facilitating the downward passage of the drilling liquid between the well and the intermediate portion 4.

It has been found that use of the above described drill pipe joint eliminates or at least considerably reduces losses of drilling liquid in circulation and makes it possible to pass through lost circulation zones without slowing down the drilling operations, while normal circulation of the drilling liquid is maintained. This result, which was a priori unexpected, appears to be able to be explained by the negative pressure effect created at the internal passages, in conjunction with the action of entrainment of the debris resulting from the acceleration of the speed of circulation of the drilling liquid above the intermediate portion, whereas, if the drill pipe joint were not provided, the existence of a lost circulation zone would bring about an accumulation of drilling debris in the drilling liquid and consequently an increase of hydrostatic pressure in the annular space. Furthermore, the drill pipe joint serves as stabilizer for the rod string inside the borehole, because of the widening of the intermediate portion.

In addition, by providing the upper face of the intermediate portion with reinforcements of a hard material, the drill pipe joint can be used as an upwardly acting drill during the raising of the drill pipe, thereby preventing jamming of the latter in the borehole.

There is thus provided a drill pipe joint which, when disposed in the drill pipe above a lost circulation zone, facilitates passage through this zone and avoids the disadvantages mentioned above.

We claim:

1. A drill pipe joint comprising a body elongated on a vertical axis, provided internally with an axial bore, and comprising upper and lower generally cylindrical end portions provided at their free ends with screw connection means for connection of the joint into a drill pipe, and an intermediate widened portion whose outside diameter is greater than the outside diameter of said upper portion and which has an upper face at its connection to said upper portion, said intermediate portion being provided with at least three cutouts, each of which cuts into said upper face and extends to said axial bore and which are regularly distributed circumferentially thereof relative to one another, and attached members each inserted into a respective said cutout, each attached member defining an upwardly directed internal passage opening at the lower end thereof into said bore and provided at the upper end thereof with a nozzle which is situated on a diameter intermediate the outside diameter of said intermediate portion and the outside diameter of said upper portion.

2. A drill pipe joint according to claim 1, wherein said upper face is provided with reinforcements of a hard material.

3. A drill pipe joint according to claim 1, wherein said upper face has a generally frustoconical shape, and each cutout forms therein an opening lying between inwardly directed edges of the drill pipe joint.

4. A drill pipe joint according to claim 3, wherein said body is provided with reinforcements of a hard material on what remains of the outside periphery of said upper face after said cutouts have been made, and on those of said edges which, in accordance with the sense of rotation of the drill pipe, form leading edges.

5. A drill pipe joint according to claim 1, wherein said intermediate portion has a cylindrical surface which is provided with helical grooves.

6. A drill pipe joint according to claim 1, wherein each said attached member is removable and is made of treated steel and is held in place by at least one pin which is inserted into aligned holes in said attached member and said intermediate portion and is retained by a screw.

7. A drill pipe joint according to claim 1, wherein each nozzle is interchangeable and is made of tungsten carbide and is retained by a circlip.

8. A drill pipe joint according to claim 1, wherein each attached member includes a cylindrical portion engaging in a correspondingly shaped part of said respective cutout in the region of said axial bore, and a seal is inserted around said cylindrical portion.

* * * * *